US007540404B2

(12) United States Patent
Arai

(10) Patent No.: US 7,540,404 B2
(45) Date of Patent: Jun. 2, 2009

(54) PACKAGING BOX

(75) Inventor: Ken Arai, Osaka (JP)

(73) Assignee: Rohto Pharmaceutical Co., Ltd. (JP)

( * ) Notice: Subject to any disclaimer, the term of this patent is extended or adjusted under 35 U.S.C. 154(b) by 18 days.

(21) Appl. No.: 11/596,243

(22) PCT Filed: May 10, 2005

(86) PCT No.: PCT/JP2005/008512

§ 371 (c)(1),
(2), (4) Date: Nov. 13, 2006

(87) PCT Pub. No.: WO2005/110867

PCT Pub. Date: Nov. 24, 2005

(65) Prior Publication Data

US 2007/0228130 A1 Oct. 4, 2007

(30) Foreign Application Priority Data

May 13, 2004 (JP) ..... 2004-143787

(51) Int. Cl.
*B65D 5/02* (2006.01)
*B65D 17/28* (2006.01)

(52) U.S. Cl. ..... 229/102; 229/153; 229/223; 229/236; 229/243

(58) Field of Classification Search ..... 229/102, 229/152, 153, 223, 236, 243; 206/806
See application file for complete search history.

(56) References Cited

U.S. PATENT DOCUMENTS

| | | | | |
|---|---|---|---|---|
| 1,940,849 | A * | 12/1933 | Davidson | 229/223 |
| 3,478,868 | A * | 11/1969 | Nerenberg et al. | 206/439 |
| 4,062,486 | A * | 12/1977 | Goodrich | 229/223 |
| 4,643,315 | A | 2/1987 | Hopwood et al. | |
| 4,770,338 | A * | 9/1988 | Tatusch | 229/102 |
| 7,055,692 | B2 * | 6/2006 | Waga et al. | 206/497 |

FOREIGN PATENT DOCUMENTS

| | | |
|---|---|---|
| JP | 55-56234 | 4/1980 |
| JP | 60-129326 | 8/1985 |
| JP | 2001-58632 | 3/2001 |
| JP | 2001-72041 | 3/2001 |

* cited by examiner

*Primary Examiner*—Gary E Elkins
(74) *Attorney, Agent, or Firm*—Gerald E. Hespos; Anthony J. Casella

(57) ABSTRACT

A packaging box (10) includes a pair of lids (2, 3), and the pair of lids (2, 3) have tongues (2*b*, 3*b*) extending from their heads and lid gluing portions (2*c*, 3*c*) arranged in specific areas on the outer surfaces of these tongues (2*b*, 3*b*). A body (1) of the packaging box (10) has a pair of body gluing portions (1*f*, 1*g*) individually glued to the lid gluing portions (2*c*, 3*c*) and at least one transverse split-open portion (5) for guiding a fracture in a side face of the packaging box (10). Both open-side ends (1*e*) have side-end split-open portions (6, 7) arranged so as to surround the body gluing portions (1*f*, 1*g*). Thus, even if the tongues provided at the heads of the lids are glued to side plates, the packaging box can be easily and accurately split and spread.

4 Claims, 10 Drawing Sheets

PACKAGING BOX

BACKGROUND OF THE INVENTION

1. Field of the Invention

The present invention relates to a packaging box for a food article, a cosmetic article, a medicine and the like.

2. Description of the Related Art

For example, as a packaging box for foods, cosmetics, medicines and the like, the one is known which includes a cylindrical body formed by four side plates and lids provided in two openings at the top and bottom of the body.

Generally, in such a packaging box, each lid can be opened and closed on its connection part as a crease to the body of the packaging box. At the front end of each lid, a tongue is provided which extends so as to be inserted. After an article is stored in the packaging box, the tongue as a strip to be inserted is tucked into the cylindrical body. Then, the tongue and a side plate of the body are glued together so that the packaging box can be sealed with an adhesive or the like. In this state, it is distributed as a product.

In such a packaging box, if an article to be stored is, for example, a medicine such as an eye lotion, then generally, this product, as well as a sheet of paper on which its effect and the like are written, are put into the box. Recently, however, removing this paper has been taken into account, because the upsurge of a movement to protect the environment has prompted a reduction in the consumption of natural resources at the maximum. Instead of the paper sheet, various prescriptions are expected to be written on the interior surface of the packaging box.

However, in order to read this description on the packaging box, the packaging box needs to be spread out by cutting it with scissors or the like. If a person attempts to split the packaging box by hand without using scissors, it may be split along an unexpected direction. This would disable the person from reading the interior description. Particularly, if a box with a glued opening part to secure its virginity or such another is used, then when it is spread out, a part of the paste may remain without being peeled off, or another such thing can occur. This not only makes it hard to look at the description for sure, but also spoils the neatness of the description. Thus, the person may throw away the box without keeping it. Besides, if the person cannot read the description items, the person may mistake how to use the medicine. If such an incident occurs when a medicine or the like is taken, that would raise a serious problem.

Hence, in the case of such a packaging box, in order to allow a person to read the interior description, the packaging box needs to be configured so as to be easily and accurately split and spread.

This kind of packaging box which can be easily and accurately split and spread has another advantage. It is useful as a packaging box in which a product stored therein can be easily taken out. Specifically, in a small packaging box or such another, its content is difficult to take out, depending upon what the product is. Taking into account the present circumstances in which an aging society has arrived and the elderly population has become larger, it is thought that the packaging box which can be easily and accurately split and spread is in great demand, because even an aged person can take out a product easily.

Therefore, in recent years, in view of this situation, as what can be easily and accurately split and spread, various packaging boxes have been proposed each of which is configured so as to guide the direction of a fraction by making a split-open part such as scores in its body.

For example, Japanese Unexamined Patent Publication No. 2001-58632 discloses a configuration of such a packaging box. In the packaging box, four side plates are disposed to have a cylindrical shape and are formed so as to be folded. It is formed so that its top part can be opened. In the side plates, an interior-surface indication portion is provided in which a portion to be cut off is formed so that the four side plates can be spread.

However, in the above-described packaging box disclosed in the publication, a tongue as a strip to be inserted which is provided at the head of a lid is not supposed to be glued to any side plate. In terms of many kinds of products, in order to prevent an article from being dishonestly altered when distributed or such a falsification, after the article is stored in the packaging box, the tongue as a strip to be inserted is tucked into the cylindrical body. Then, the tongue and a side plate of the body are glued together so that the packaging box can be sealed with an adhesive or the like. In this state, it is distributed as a product.

In the above described packaging box disclosed in the publication, in the case where the tongue at the head of the lid is glued to a side plate, if a part of the paste remains without being peeled off or another such thing can occur when the box is spread out, that will make it difficult to look at and confirm the contents of a description, as well as spoil the neatness of the description. Hence, this packaging box disclosed in the publication is not the one which can be easily and accurately split and spread, including gluing portions.

SUMMARY OF THE INVENTION

It is an object of the present invention to provide a packaging box which is free from the above described problems.

It is another object of the present invention to provide a packaging box which can be easily and accurately split and spread.

It is another object of the present invention to provide a packaging box which is capable of taking out a product stored therein more easily, and reading the contents of a description on the interior surface thereof, even if a tongue provided at the head of a lid is glued to a side plate thereof.

According to an aspect of the present invention, a packaging box includes a cylindrical body, and a pair of lids which are each provided in a pair of openings of this cylindrical body. The pair of lids each have a tongue which extends from their heads, the tongue being disposed so that it is opened and closed on its connection portion as a crease to the body of the packaging box with respect to the body of the packaging box, and a lid gluing portion which is arranged in a specific area on the outer surface of each tongue. The body of the packaging box has a pair of body gluing portions which are individually glued to each lid gluing portion, the body gluing portions being arranged in each specific area of both open-side ends where they are placed on top of and joined to each tongue, and at least one transverse split-open portion which guides a fracture from one opening to the other opening in a side face of the packaging box. Both open-side ends have side-end split-open portions which guide a fracture so that the body gluing portions are separated from the body when the body gluing portions are kept glued to the lid gluing portions, the side-end split-open portions being arranged so as to surround the body gluing portions.

These and other objects, features, aspects, and advantages of the present invention will become more apparent from the following detailed description of the preferred embodiments/examples with reference to the accompanying drawings.

DETAILED DESCRIPTION OF THE PREFERRED EMBODIMENTS

Figure 1:
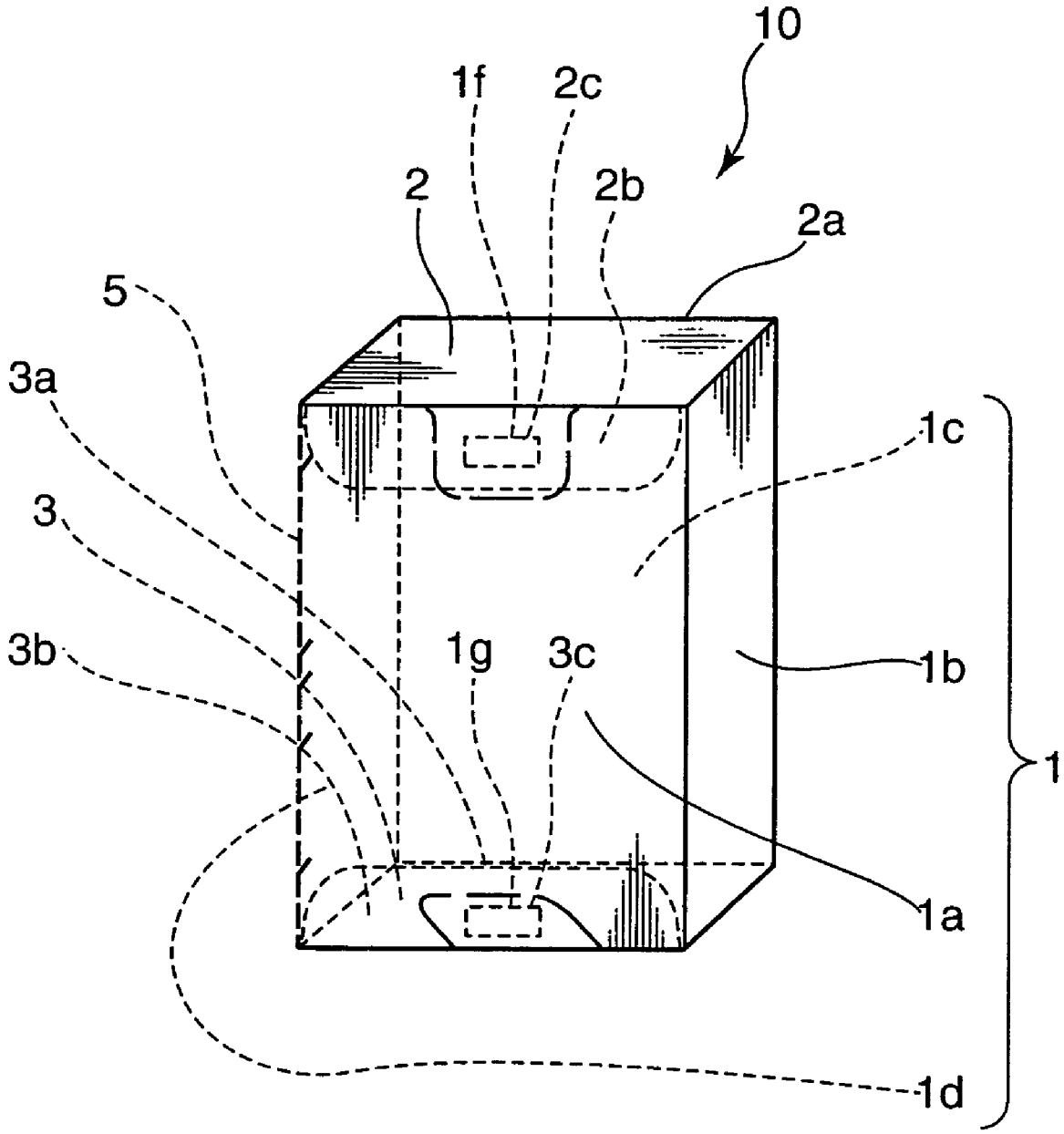
FIG. 1 is a perspective view of a packaging box according to an embodiment of the present invention, showing its configuration.
Figure 2:
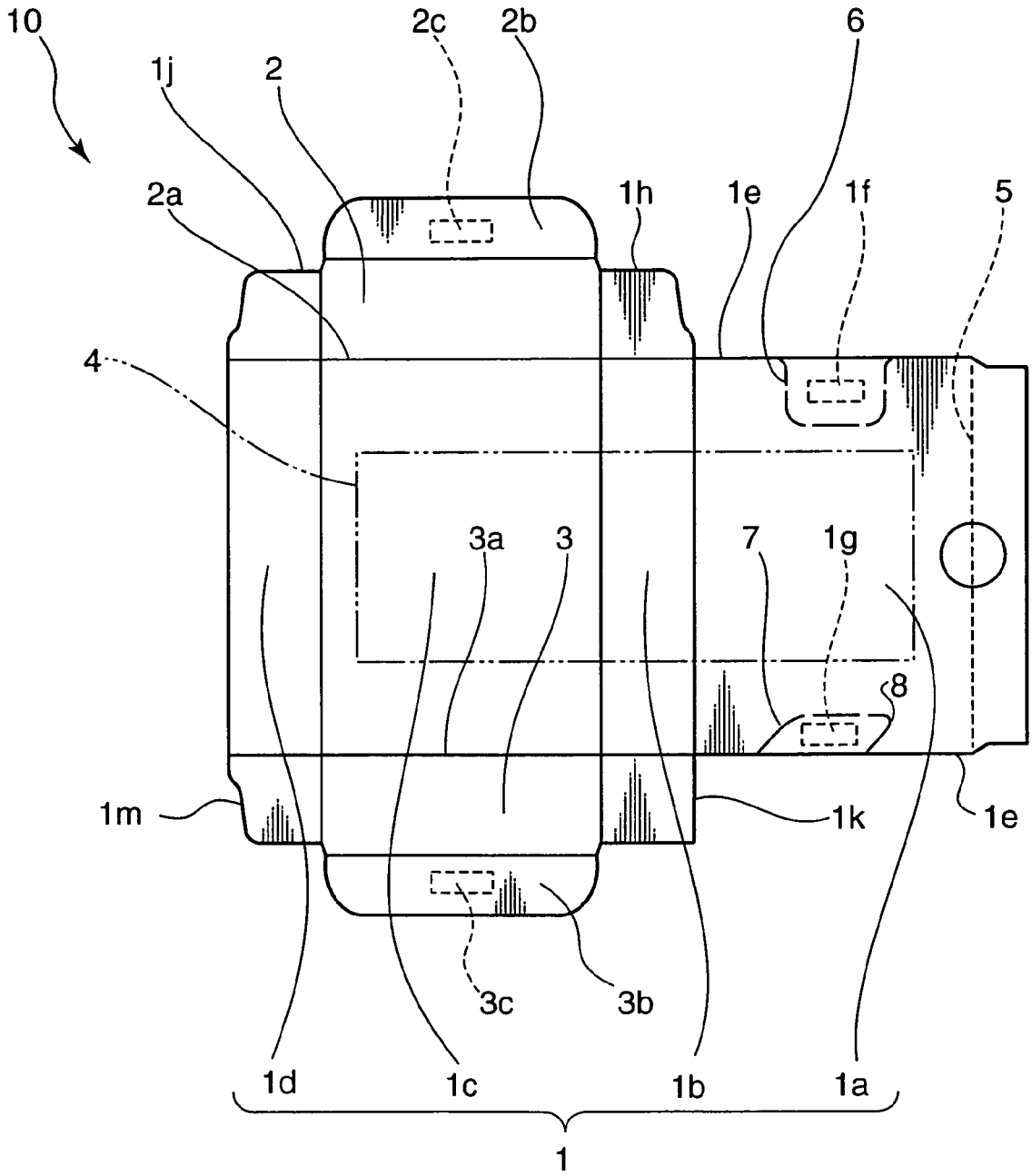
FIG. 2 is a front view of the packaging box according to the embodiment of the present invention, showing its configuration when spread.

Hereinafter, a preferred embodiment of the present invention will be described in detail with reference to the attached drawings. FIG. 1 is a perspective view of a packaging box 10 according to the embodiment of the present invention, showing its configuration. FIG. 2 is a front view of the packaging box 10 according to the embodiment of the present invention, showing its configuration when spread.

As shown in FIG. 1 and FIG. 2, the packaging box 10 according to the embodiment of the present invention is, for example, a cardboard box which is used as a packaging body for a food article, a cosmetic article, a medicine and the like. It has a substantially rectangular-parallelepiped shape and can be flat when spread. This packaging box 10 is a case body made of cardboard which includes a cylindrical body 1 formed by four side plates 1*a*, 1*b*, 1*c*, 1*d*, and a pair of lids 2, 3 which are provided in each of a pair of openings at the top and bottom of this cylindrical body 1. In the interior surface of the body 1, an indication portion 4 (see FIG. 2) is provided which indicates information, such as a description on usage or handling.

The above described pair of lids 2, 3 each are connected at connection portions 2*a*, 3*a* to the body 1 of the packaging box 10. Each connection portion 2*a*, 3*a* is designed to be a crease, and thus, each lid 2, 3 can be opened and closed on the crease as an axis with respect to the body 1 of the packaging box 10. Each lid 2, 3 includes a tongue 2*b*, 3*b* which extends from their heads, and a lid gluing portion 2*c*, 3*c* which is arranged in a specific area of a substantially central part on the outer surface of each tongue 2*b*, 3*b*.

The body 1 of the above described packaging box 10 includes: a pair of body gluing portions 1*f*, 1*g* which are individually glued to each lid gluing portion 2*c*, 3*c*, the body gluing portions being arranged in each specific area of both open-side ends where they are placed on top of and joined to each tongue 2*b*, 3*b*; flaps 1*h*, 1*j* and 1*k*, 1*m* (see FIG. 2) which are folded and joined to each lid 2, 3; and at least one scored transverse split-open portion 5 which guides a fracture from one opening to the other opening in a side face of the packaging box. In addition, both open-side ends 1*e* includes scored side-end split-open portions 6, 7 which guide a fracture so that the body gluing portions 1*f*, 1*g* are separated from the body with kept glued to the lid gluing portions 2*c*, 3*c*, the side-end split-open portions 6, 7 being arranged so as to surround the body gluing portions 1*f*, 1*g*.

Figure 3:
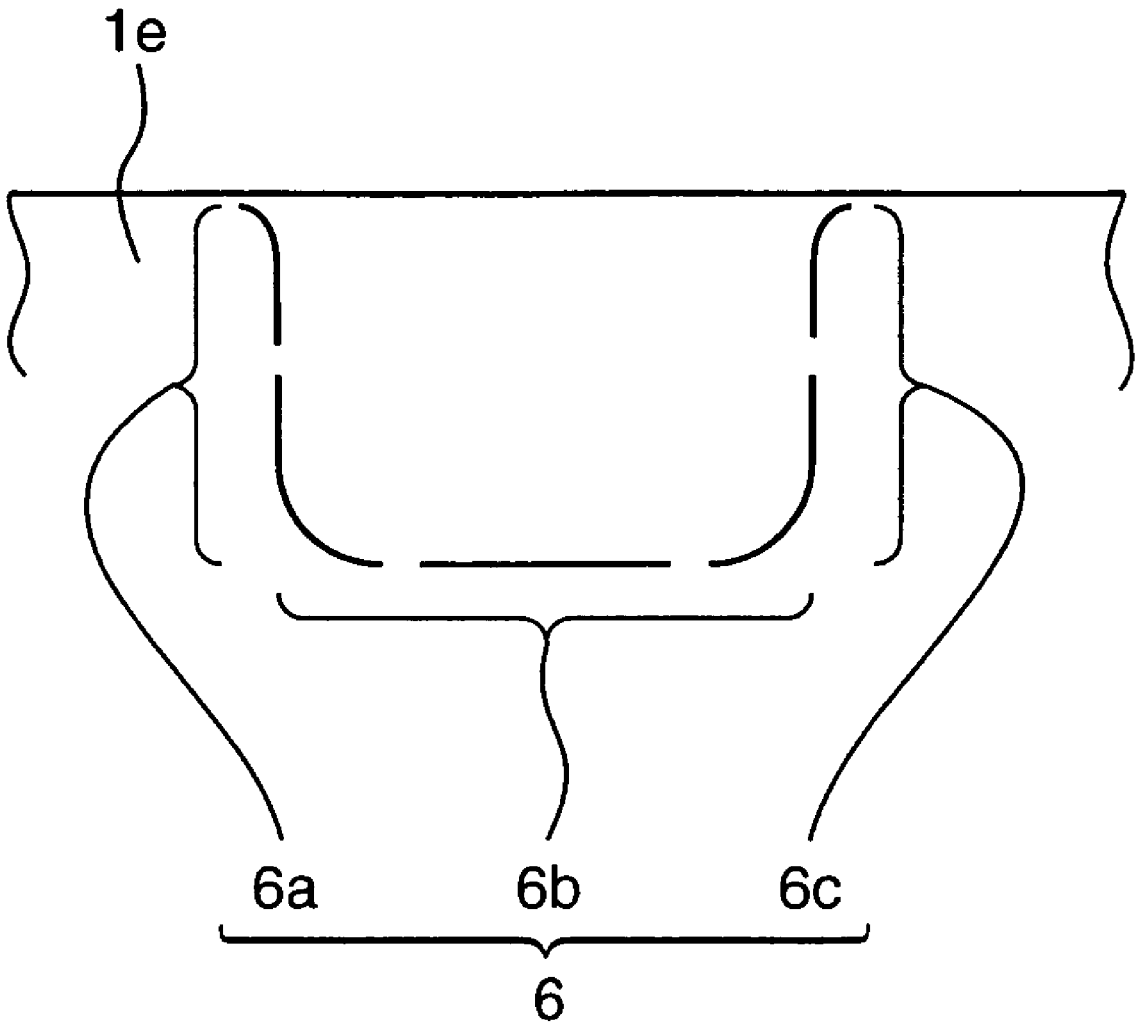
FIG. 3 is an illustration, showing the configuration of one side-end split-open portion of the packaging box according to the embodiment of the present invention.
Figure 4:
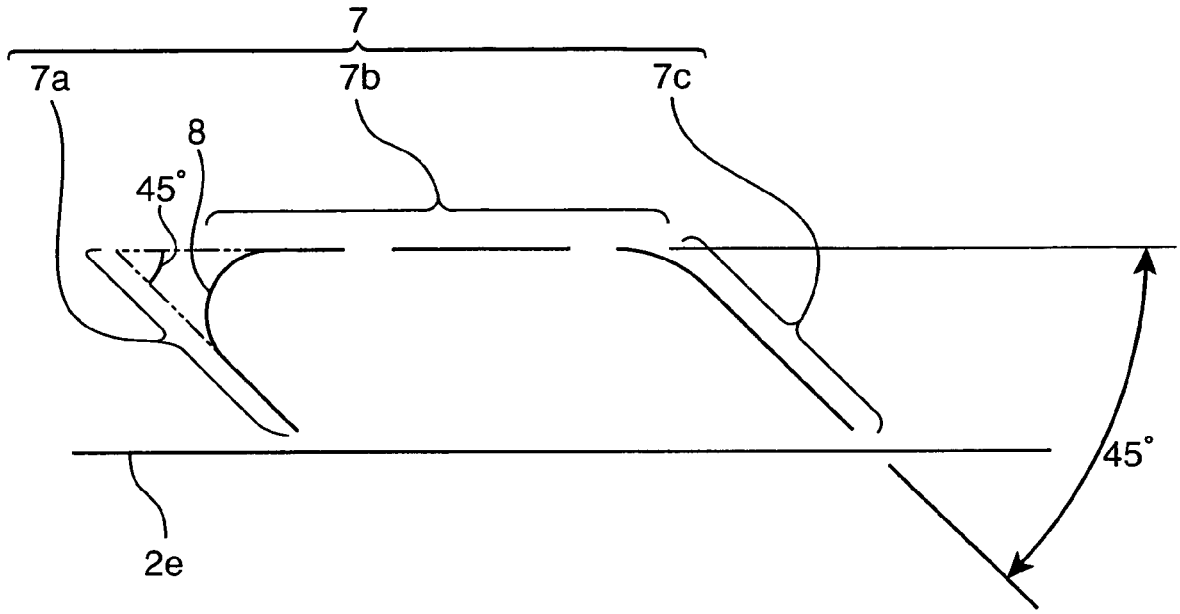
FIG. 4 is an illustration, showing the configuration of the other side-end split-open portion of the packaging box according to the embodiment of the present invention.

Herein, FIG. 3 is an illustration, showing the configuration of the side-end split-open portion 6 of the packaging box 10 according to the embodiment of the present invention. FIG. 4 is an illustration, showing the configuration of the side-end split-open portion 7 of the packaging box 10 according to the embodiment of the present invention.

As shown in FIG. 3, the side-end split-open portion 6 is formed by: a first fracture guiding portion 6*a* which starts from a position on the side of an open-side end 1*e* of the body 1; a second fracture guiding portion 6*b* which is substantially parallel to the side of this open-side end 1*e*; and a third fracture guiding portion 6*c* which ends in another position of the side of the open-side end 1*e*.

As shown in FIG. 4, the side-end split-open portion 7 is formed by: a first fracture guiding portion 7*a* which extends in the direction inclining toward the transverse split-open portion 5 from a position on the side of an open-side end 1*e* of the body 1; a second fracture guiding portion 7*b* which is substantially parallel to the side of this open-side end 1*e*; and a third fracture guiding portion 7*c* which ends in another position of the side of the open-side end 1*e*. Herein, the first fracture guiding portion 7*a* and the second fracture guiding portion 7*b* cross at an angle of 45 degrees. Likewise, the second fracture guiding portion 7*b* meets the third fracture guiding portion 7*c* at an angle of 45 degrees. The third fracture guiding portion 7*c* is substantially parallel to the first fracture guiding portion 7*a*.

In addition, the first fracture guiding portion 7*a* and the second fracture guiding portion 7*b* connect, at their closest part to the transverse split-open portion 5, by a substantially U-shaped cut portion 8 which guides a fracture in each fracture guiding portion 7*a*, 7*b*. Thus, if split from the side of the transverse split-open portion 5, then at their closest part to the transverse split-open portion 5, each fracture guiding portion 7*a*, 7*b* begins to be split in the same timing.

Next, an operation of the packaging box 10 according to the embodiment of the present invention will be described with reference to FIG. 5 to FIG. 7.

Figure 5:
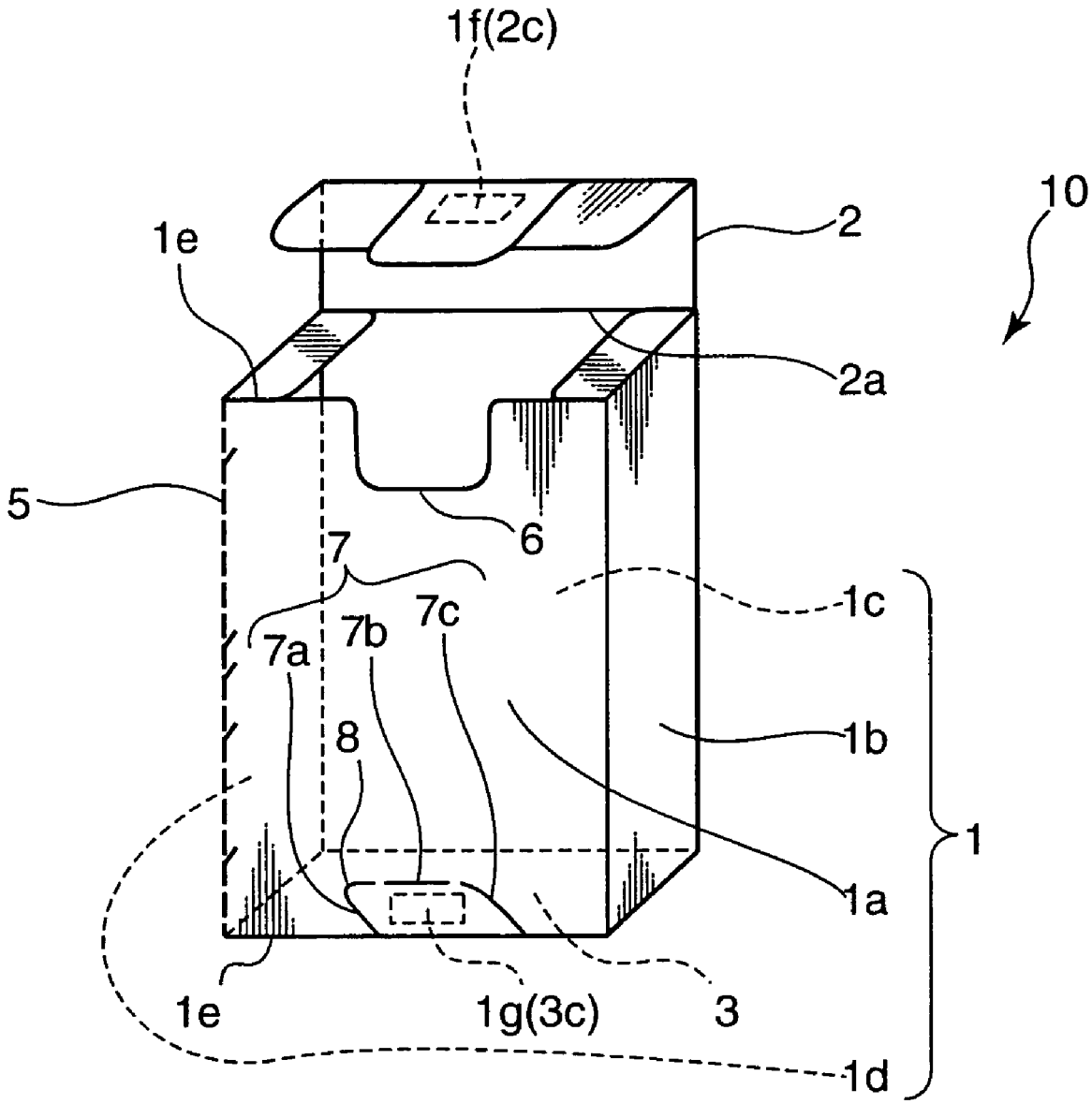
FIG. 5 is a perspective view of the packaging box, showing a state in which one side-end split-open portion is pressed and split and a body gluing portion is separated from a body with kept glued to a lid gluing portion.

FIG. 5 is a perspective view of the packaging box, showing a state in which the side-end split-open portion 6 on one side is pressed and split, and the body gluing portion 1*f* is separated from the body 1 with kept glued to the lid gluing portion 2*c*. In this state, the lid 2 on this side can be opened and closed on a crease as an axis with respect to the body 1 of the packaging box 10. Its connection portion 2*a* to the body 1 of the packaging box 10 corresponds to the crease.

Figure 6:
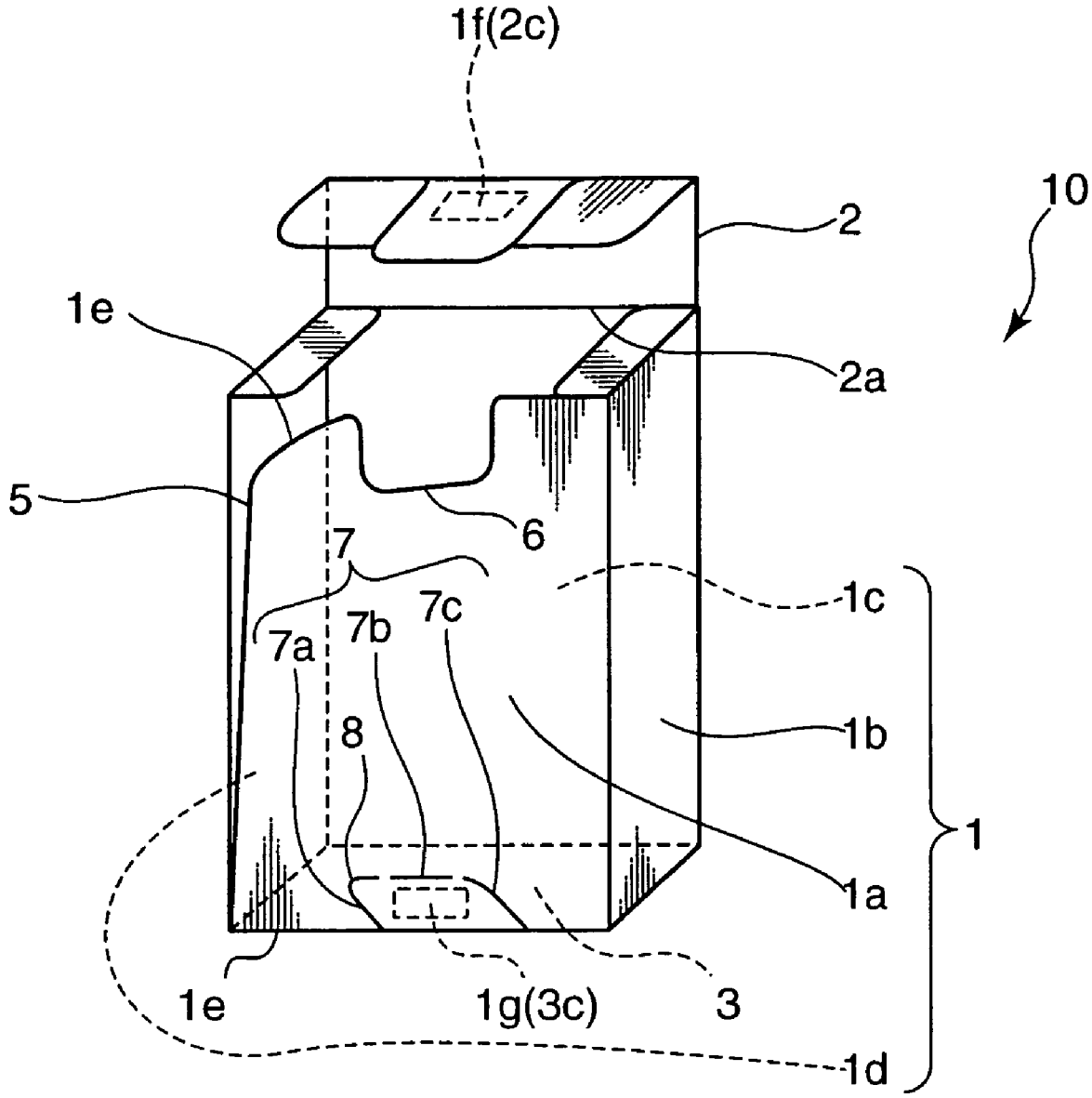
FIG. 6 is a perspective view of the packaging box, showing a state in which after a lid is opened, the packaging box is being split along a transverse split-open portion which guides a fracture in a side face of the packaging box from this opening toward the other opening.

FIG. 6 is a perspective view of the packaging box, showing a state in which after the lid 2 is opened, the packaging box 10 is being split along the transverse split-open portion 5 which guides a fracture in a side face of the packaging box 10 from this opening toward the other opening.

Figure 7:
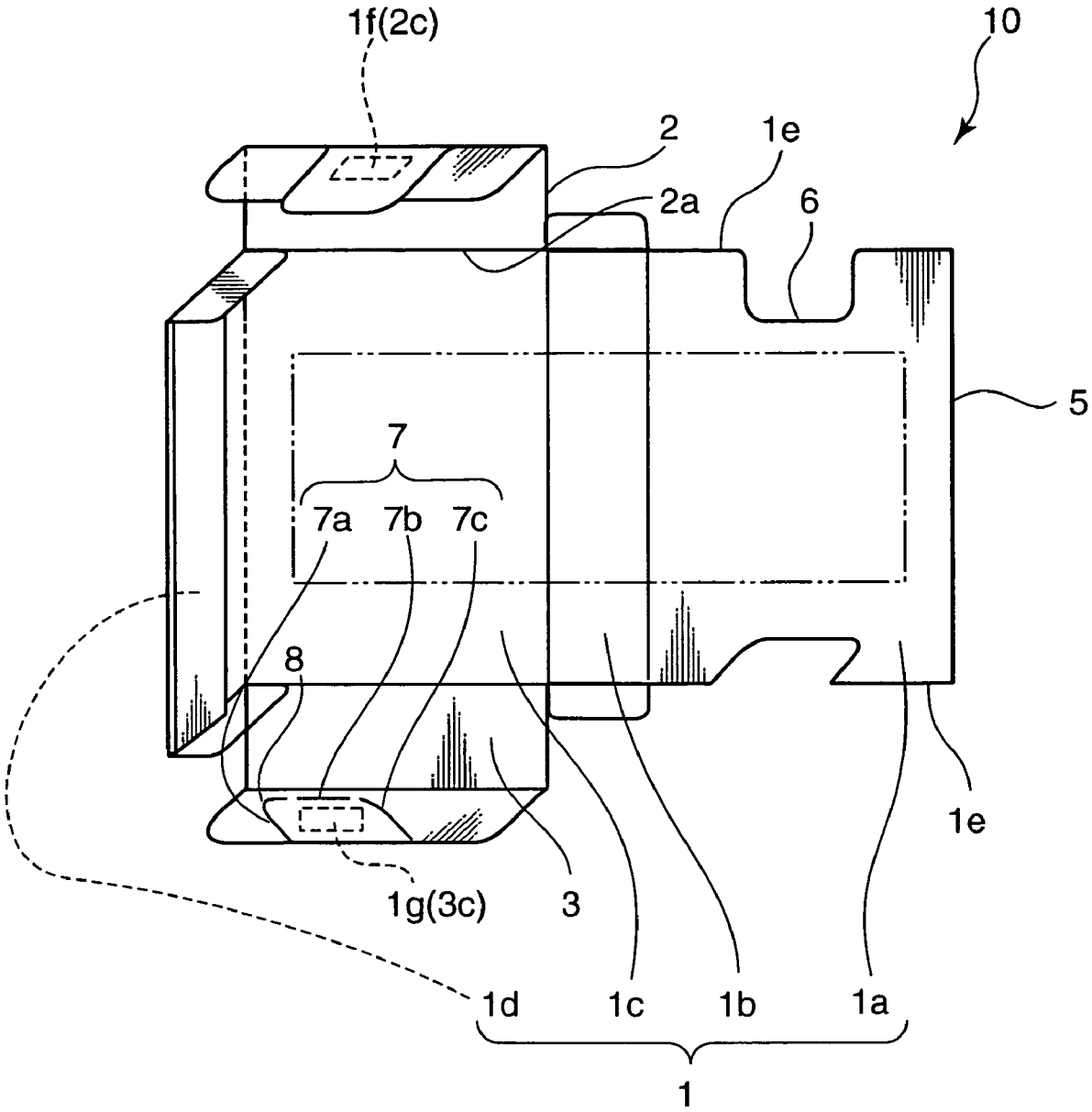
FIG. 7 is a perspective view of the packaging box, showing a state in which the other side-end split-open portion is split, a body gluing portion is separated from the body with kept glued to a lid gluing portion, and then, the packaging box is spread to be almost flat.

FIG. 7 is a perspective view of the packaging box, showing a state in which the side-end split-open portion 7 on the other side is split, the body gluing portion 1*g* is separated from the body 1 with kept glued to the lid gluing portion 3*c*, and then, the packaging box 10 is spread to be almost flat. In this state, the side-end split-open portion 7 is split from the side of the transverse split-open portion 5. Thereby, it can be easily split without departing from the first fracture guiding portion 7*a* and the second fracture guiding portion 7*b*. At this time, the substantially U-shaped cut portion 8 helps each fracture guiding portion 7*a*, 7*b* start to be split in the same timing. In this state, the lid 3 on the other side is kept opened on the connection portion 3*a* as a crease with respect to the body 1 of the packaging box 10. In this state, the indication portion 4 for indicating information which is provided in the interior surface of the body 1 becomes readable.

As described above, in the packaging box 10 according to the embodiment of the present invention, at both open-side ends 1*e*, the body 1 of the packaging box 10 includes the side-end split-open portions 6, 7 which have a substantially U-shape so as to surround the body gluing portions 1*f*, 1*g*. Therefore, even if the side-end split-open portions 6, 7 are each split from its starting end or finishing end, the body gluing portions if, 1*g* are each pressed from outside. On the other hand, even if the side-end split-open portions 6, 7 are each split from halfway, the portions in vicinity of the body gluing portions 1*f*, 1*g* can each be split. Besides, the body gluing portions 1*f*, 1*g* are each separated from the body with kept glued to each lid gluing portion 2*c*, 3*c*, thus helping release the lids 2, 3 easily.

Furthermore, the body 1 of this packaging box 10 includes at least one such transverse split-open portion 5 which has scores and guides a fracture from one opening to the other opening in a side face of the packaging box 10. Therefore, the side face of the body 1 can be accurately split along this transverse split-open portion 5.

Hence, first, the side-end split-open portion 6 on one side is pressed and split to open the lid 2, and thereafter, the transverse split-open portion 5 is split from the side of this opening. Continuously from this state, the side-end split-open portion 7 on the other side is split, or such another is conducted. Thereby, the packaging box 10 can be easily spread.

In this way, in the packaging box 10, even if the tongues 2*b*, 3*b* provided at the heads of the lids 2, 3 are glued to side plates, the packaging box 10 can be easily and accurately split and spread.

Moreover, in this packaging box 10, the first fracture guiding portion 7*a* of the side-end split-open portion 7 is formed in the direction inclining toward the transverse split-open portion 5 from a position on the side of an open-side end 1*e* of the body 1. The second fracture guiding portion 7*b* is formed in substantially parallel with the side of the open-side end 1*e* of the body 1. Therefore, if the side-end split-open portion 7 is split from the side of the transverse split-open portion 5, the side-end split-open portion 7 can be easily split without departing from the first fracture guiding portion 7*a* and the second fracture guiding portion 7*b*.

In addition, the third fracture guiding portion 7*c* is substantially parallel to the first fracture guiding portion 7*a*. Therefore, in the same way as the first fracture guiding portion 7*a*, the side-end split-open portion 7 can be split without deviating from the third fracture guiding portion 7*c*.

Furthermore, both the first fracture guiding portion 7*a* and the second fracture guiding portion 7*b* connect by the substantially U-shaped cut portion 8 provided at their closest part to the transverse split-open portion 5. This makes it possible to start splitting each fracture guiding portion in the same timing. As a result, the side-end split-open portion 7 can be smoothly split.

Moreover, in this packaging box 10, the packaging box 10 can be easily and accurately split and spread, as well as a description can be expressed on its interior surface. This helps remove a separate sheet of description paper, and thus, reduce the consumption of natural resources to the utmost.

Next, variations of the packaging box 10 according to the embodiment of the present invention will be described with reference to FIG. 8 to FIG. 10.

Figure 8:
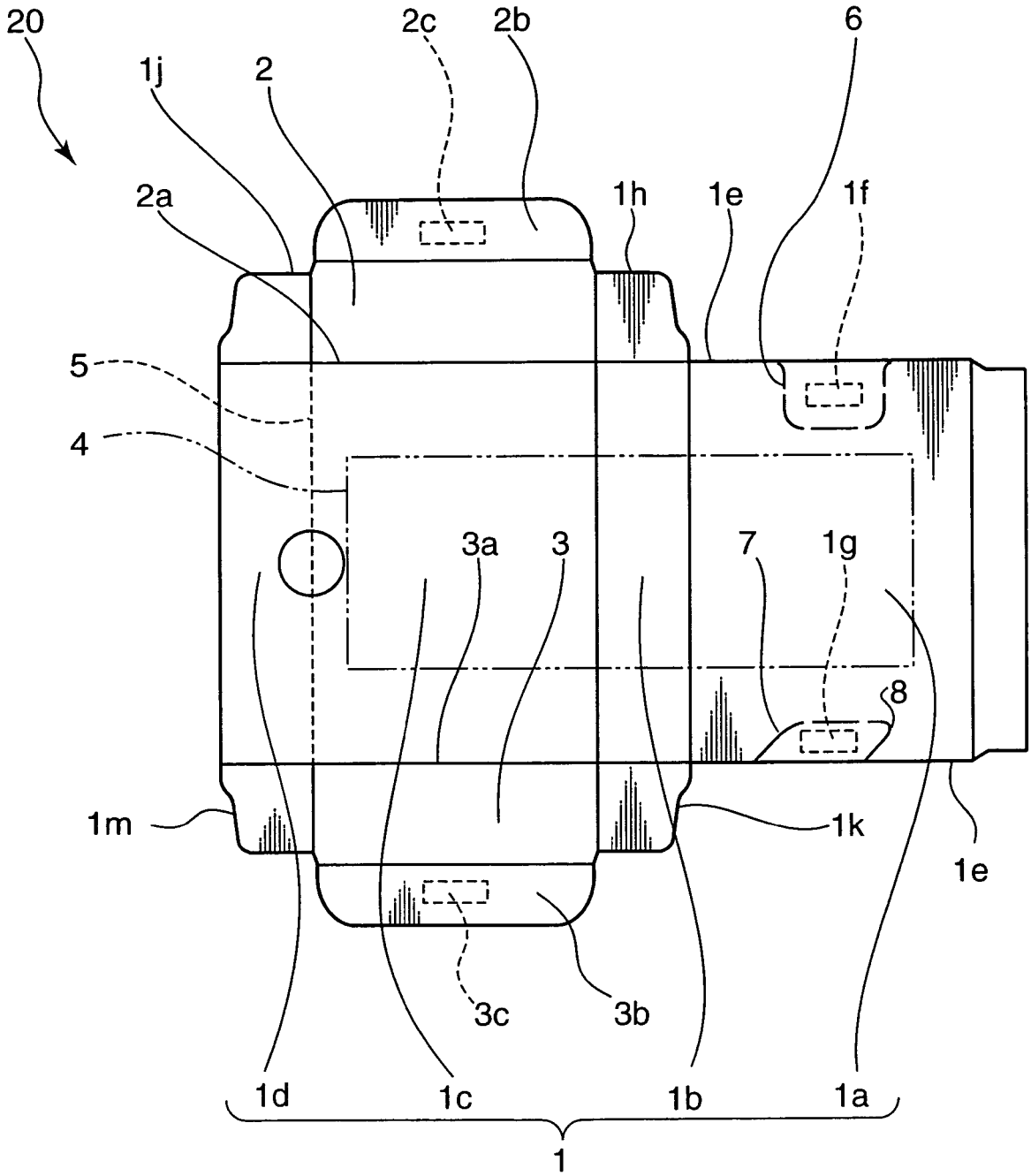
FIG. 8 is a front view of a first variation of the packaging box according to the embodiment of the present invention.

FIG. 8 is a front view of a packaging box 20 according to a first variation of the present invention, showing its configuration when spread.

As shown in FIG. 8, in the packaging box 20 according to the first variation, a transverse split-open portion 5 is provided on one side of a side plate 1*c* opposite to a side plate 1*a* which includes side-end split-open portions 6, 7. Even in this case, the position of the transverse split-open portion 5 is shifted by the width of only one side plate. Thus, the packaging box 20 can be easily spread in the same way as the packaging box 10.

Figure 9:
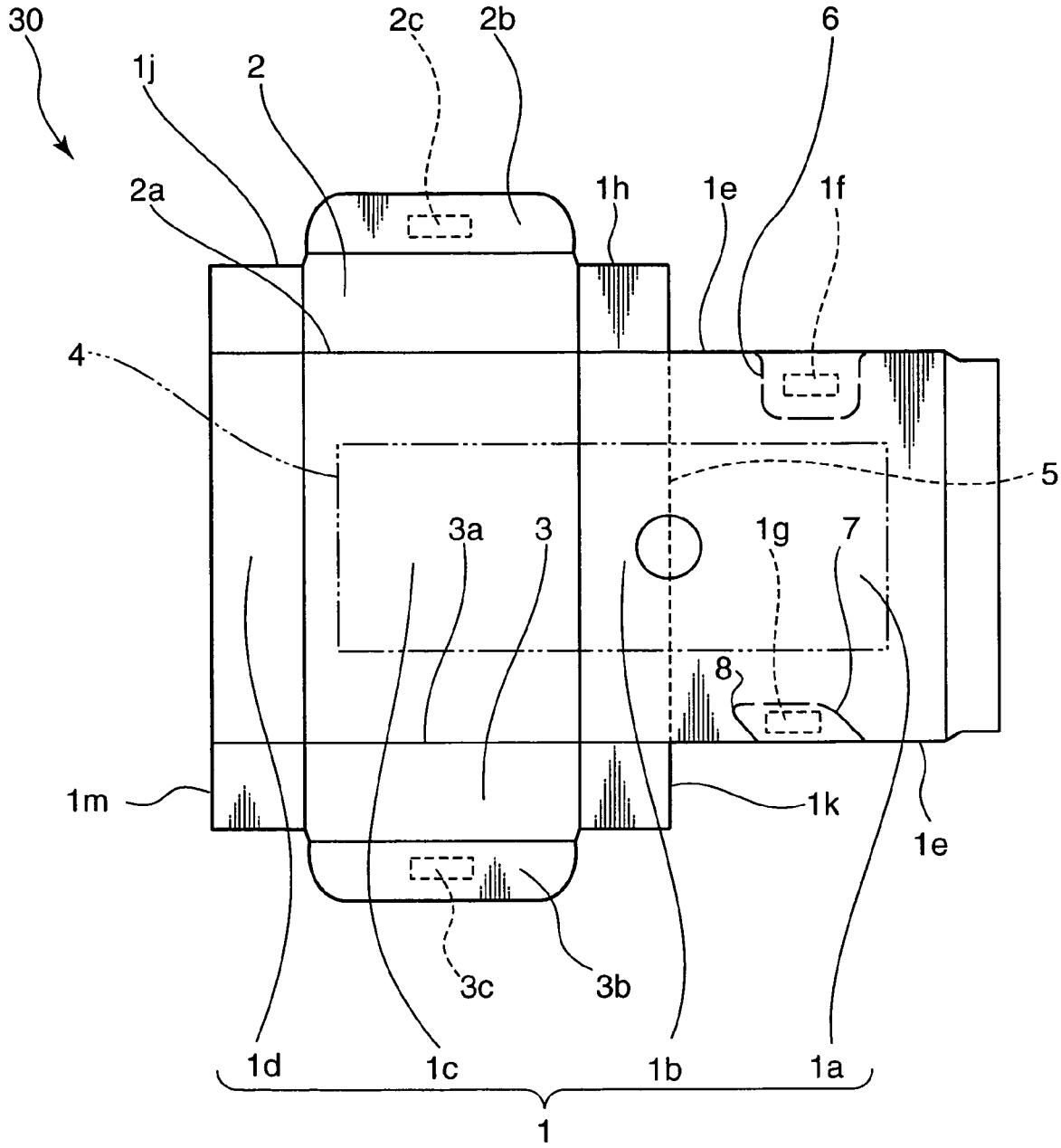
FIG. 9 is a front view of a second variation of the packaging box according to the embodiment of the present invention.

FIG. 9 is a front view of a packaging box 30 according to a second variation of the present invention, showing its configuration when spread.

As shown in FIG. 9, in the packaging box 30 according to the second variation, a transverse split-open portion 5 is provided on another side of a side plate 1*a* which includes side-end split-open portions 6, 7. Even in this case, the orientation of the side-end split-open portion 7 on the other side is only changed. Thus, the packaging box 30 can be easily spread in the same way as the packaging box 10.

Figure 10:
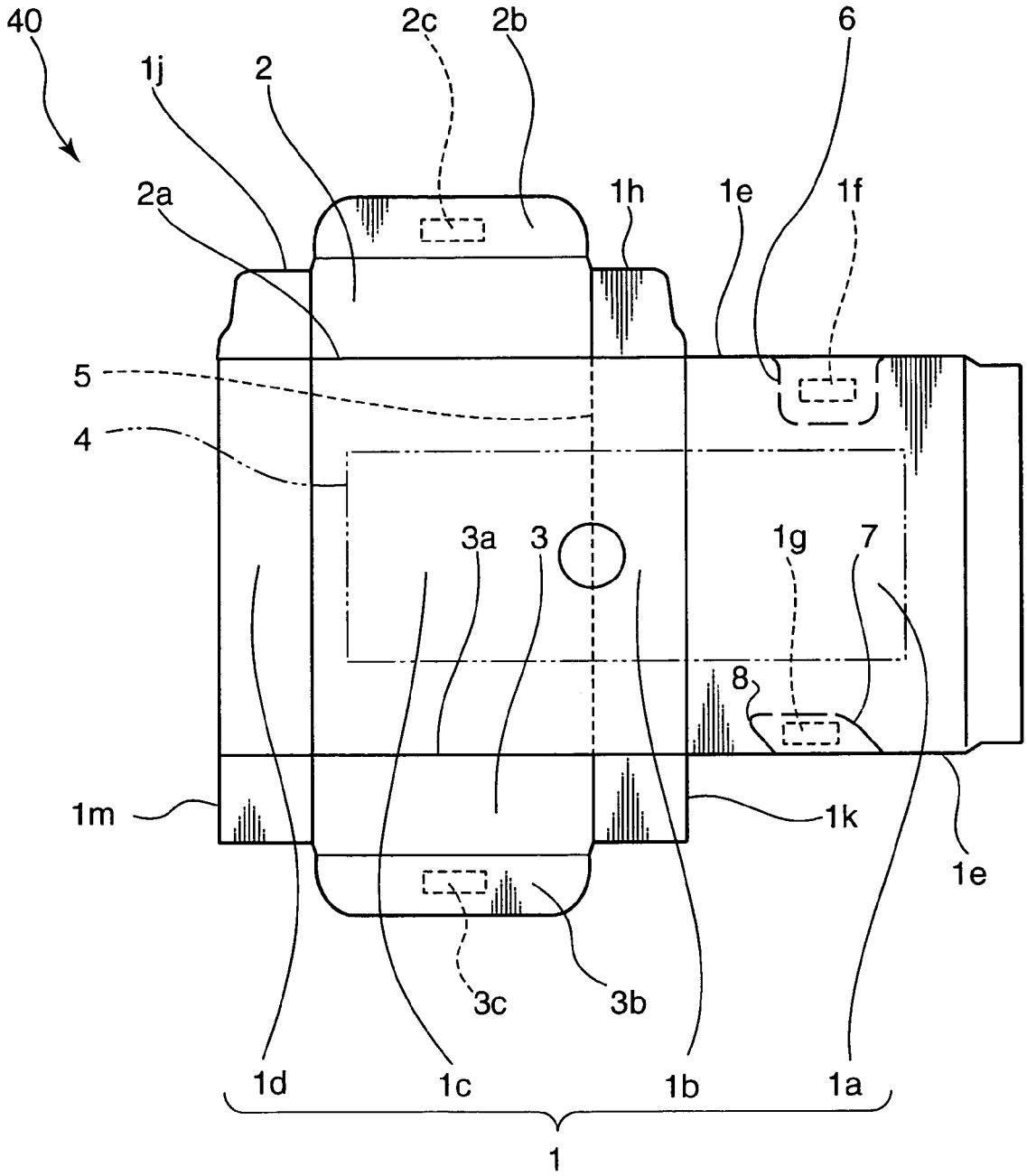
FIG. 10 is a front view of a third variation of the packaging box according to the embodiment of the present invention.

FIG. 10 is a front view of a packaging box 40 according to a third variation of the present invention, showing its configuration when spread.

As shown in FIG. 10, in the packaging box 40 according to the third variation, different from the packaging box 10, a transverse split-open portion 5 is changed on one side of a side plate 1*b*. Even in this case, the position of the transverse split-open portion 5 is simply shifted, so that the packaging box 40 can be easily spread in the same way as the packaging box 10.

The above described embodiment merely illustrates a specific preferred example of the present invention. Hence, the present invention is not limited to this embodiment.

For example, the packaging box 10 is not necessarily limited to a box used as a packaging container for a food article, a cosmetic article, a medicine and the like. It can be applied to a packaging container for a household electrical appliance, a toy, or a product in another field.

Next, in terms of the raw material, material, thickness and the like which can be used for the packaging box 10, taking into account the necessity of writing a description or the like on the indication portion 4 and splitting and spreading it easily, preferably, paper such as thick paper and cardboard should be used. However, depending upon suitability for a product manufacturing process or the like, various materials including a plastic sheet, thin paper and the like can be properly selected, as long as the advantages obtained by the present invention are not hindered. Besides, the packaging box 10 is provided additionally with a hitching member such as a hook, a hanging member such as a sheet of pasteboard for suspension, or the like, so that it can be hung at the store.

Furthermore, the scores of each split-open portion are not necessarily limited to a single kind, and thus, different types of scores can also be combined. Besides, depending upon the raw material of such a box, the quality of the material, suitability for a product manufacturing process, or the like, a weakening line, a combination of scores and a weakening line, or the like, may be properly selected, so long as it can be split and opened.

Moreover, as shown in FIG. 2, if the transverse split-open portion 5 is provided on the side which corresponds to the side plate 1*d* to be glued thereto, then the side plate 1*d* is reinforced, and a person can hold the side plate 1*a* in the person's right hand so as to split it easily. However, it not necessarily has to be provided on this side which corresponds to the glued side plate 1*d*. Thus, it may also be provided on any side of each side plate 1*a*, 1*b*, 1*c*, 1*d*. Besides, its location is not limited to the sides of each side plate 1*a*, 1*b*, 1*c*, 1*d*. Hence, it can also be provided so as to cross the face of each side plate 1*a*, 1*b*, 1*c*, 1*d*.

In addition, the angle at which the first fracture guiding portion 7*a* and the second fracture guiding portion 7*b* cross each other, and the angle at which the second fracture guiding portion 7*b* and the third fracture guiding portion 7*c* cross each other, as shown in the figure, not necessarily has to be 45 degrees. Hence, it can also be changed to another angle.

Incidentally, in the indication portion 4, not only a description on usage or handling is described, but also a description on warning, a product management number, or the like, can also be applied thereto. Thus, its contents can be variously changed.

Incidentally, the body gluing portions 1*f*, 1*g* and the lid gluing portions 2*c*, 3*c* only require that a paste is put on at least either of gluing portions to be glued together so that they can be stuck together. Hence, a paste not necessarily has to be applied on both.

As described above, an inventive packaging box includes a cylindrical body, and a pair of lids which are each provided in a pair of openings of this cylindrical body. The pair of lids each have a tongue which extends from their heads, the tongue being disposed so that it is opened and closed on its connection portion as a crease to the body of the packaging box with respect to the body of the packaging box, and a lid gluing portion which is arranged in a specific area on the outer surface of each tongue. The body of the packaging box has a pair of body gluing portions which are individually glued to each lid gluing portion, the body gluing portions being arranged in each specific area of both open-side ends where they are placed on top of and joined to each tongue, and at least one transverse split-open portion which guides a fracture from one opening to the other opening in a side face of the packaging box. Both open-side ends have side-end split-open portions which guide a fracture so that the body gluing portions are separated from the body when the body gluing portions are kept glued to the lid gluing portions, the side-end split-open portions being arranged so as to surround the body gluing portions.

The body of the packaging box includes the side-end split-open portions so as to surround the body gluing portions at both open-side ends. Therefore, even if a side-end split-open portion is split from its starting end or finishing end, the corresponding body gluing portion is pressed from outside. On the other hand, even if the side-end split-open portion is split from halfway, the portions in the vicinity of the body gluing portion can be split. Besides, the body gluing portion is separated from the body with kept glued to the lid gluing portion, thus helping open the corresponding lid easily.

Furthermore, the body of the packaging box includes at least one transverse split-open portion which guides a fracture from one opening to the other opening in a side face of the packaging box. Therefore, the side face of the body can be accurately split along this transverse split-open portion. Herein, the transverse means crossing from one opening to the other opening, and thus, it does not mean the lengthwise and crosswise directions.

One side-end split-open portion is pressed and split to open the corresponding lid, and thereafter, the transverse split-open portion is split from the side of this opening. Sequentially from this state, the other side-end split-open portion is split from one of its ends, or such another is conducted. Thereby, the packaging box can be easily spread.

In this way, even if a tongue provided at the head of a lid is glued to a side plate, the packaging box can be easily and accurately split and spread. Besides, in each gluing portion, a part of the paste can be prevented from remaining without being peeled off.

Preferably, at least one of the side-end split-open portions may be formed by a first fracture guiding portion which extends in the direction inclining toward the transverse split-open portion from a position on the side of an open-side end of the body, a second fracture guiding portion which is substantially parallel to the side of this open-side end, and a third fracture guiding portion which extends up to another position of the side of the open-side end.

According to this configuration, the first fracture guiding portion of a side-end split-open portion is formed in the direction inclining toward the transverse split-open portion from a position on the side of an open-side end of the body. The second fracture guiding portion is formed in substantially parallel with the side of the open-side end of the body. Therefore, if the side-end split-open portion is split from the side of the transverse split-open portion, the side-end split-open portion can be easily split without departing from the first fracture guiding portion and the second fracture guiding portion.

Furthermore, preferably, the third fracture guiding portion may be substantially parallel to the first fracture guiding portion.

According to this configuration, the third fracture guiding portion is substantially parallel to the first fracture guiding portion, so that the side-end split-open portion can be split without deviating from the third fracture guiding portion as well.

Moreover, it is preferable that the first fracture guiding portion and the second fracture guiding portion connect, at their closest part to the transverse split-open portion, by a substantially U-shaped cut portion which guides a fracture in each fracture guiding portion.

According to this configuration, both the first fracture guiding portion and the second fracture guiding portion connect by the substantially U-shaped cut portion provided at their closest part to the transverse split-open portion. This makes it possible to start splitting each fracture guiding portion in the same timing. As a result, the side-end split-open portion can be smoothly split along each fracture guiding portion.

In addition, preferably, an indication portion which indicates information may be provided at least in the interior surface of the body.

According to this configuration, a separate sheet of description paper or the like which indicates information can be eliminated. This helps reduce as much consumption of natural resources as possible.

In addition to these, needless to say, the design can be variously changed within the scope of the claims of the present invention.

As described so far, an inventive packaging box can be easily and accurately split and spread, which is capable of, for example, taking out a product stored therein more easily, and reading the contents of a description on the interior surface thereof, even if a tongue provided at the head of a lid is glued to a side plate thereof. Besides, in each gluing portion, a part of the paste can be prevented from remaining without being peeled off.

The invention claimed is:

1. A packaging box with opposite inner and outer surfaces, the inner surface defining an indication portion to indicate information, the packaging box being configured to be opened and spread flat for accessing the indication portion on the inner surface of the packaging box, the packaging box comprising:

a substantially rectangular tubular body having opposite first and second ends, opposed front and rear plates extending from the first end to the second end of the body, opposite first and second side plates hinged to the front and rear plates and extending from the first end to the second end of the body;

first and second lids joined to the rear plate along creases at the respective first and second ends of the body;

first and second tongues joined to the respective first and second lids along creases at locations on the respective first and second lids opposite the rear plate, the lids being disposed adjacent portions of the front plate facing inwardly on the packaging box;

first and second gluing portions securing the first and second tongues to the front plate at locations spaced inwardly from the first and second side plates of the body;

a side fracture guide extending substantially from the first end to the second end of the body at locations along the front plate substantially adjacent the first side plate;

a substantially U-shaped first end fracture guide formed in portions of the front plate adjacent the first end and substantially surrounding the first gluing portion, the substantially U-shaped first end fracture guide includes a first leg intersecting the first end of the body, a second leg substantially parallel to the first end of the body and a third leg intersecting the first end of the body at a location spaced from the first leg of the first end fracture guide, the first and third legs of the first end fracture guide being substantially parallel to one another and substantially perpendicular to the first end of the body; and a substantially U-shaped second end fracture guide formed in a portion of the front plate substantially adjacent the second end and surrounding the second gluing portion, the second end fracture guide includes a first leg extending from the second end of the body, a second leg aligned substantially parallel to the second end of the body and a third leg intersecting the second end of the body at a location spaced from the first leg of the second end fracture guide, the first and third legs of the second end fracture guide being substantially parallel to one another and being aligned to extend towards the side fracture guide at farther distances from the second end of the body.

2. A packaging box with opposite inner and outer surfaces, the inner surface defining an indication portion to indicate information, the packaging box being configured to be opened and spread flat for accessing the indication portion on the inner surface of the packaging box, the packaging box comprising:

a substantially rectangular tubular body having opposite first and second ends, opposed front and rear plates extending from the first end to the second end of the body, opposite first and second side plates hinged to the front and rear plates and extending from the first end to the second end of the body;

first and second lids joined to the rear plate along creases at the respective first and second ends of the body;

first and second tongues joined to the respective first and second lids along creases at locations on the respective first and second lids opposite the rear plate, the lids being disposed adjacent portions of the front plate facing inwardly on the packaging box;

first and second gluing portions securing the first and second tongues to the front plate at locations spaced inwardly from the first and second side plates of the body;

a side fracture guide extending substantially from the first end to the second end of the body at locations along the front plate substantially adjacent the first side plate;

a substantially U-shaped first end fracture guide formed in portions of the front plate adjacent the first end and substantially surrounding the first gluing portion; and a substantially U-shaped second end fracture guide formed in a portion of the front plate substantially adjacent the second end and surrounding the second gluing portion, wherein the substantially U-shaped second end fracture guide has a first leg extending obliquely from the second end of the body towards the side fracture guide, a second leg extending substantially parallel to the second end of the body and away from the side fracture guide and a third leg extending from the second end of the body towards an end of the second leg farthest from the side fracture guide.

3. The packaging box of claim 2, wherein the substantially U-shaped first end fracture guide includes a first leg intersecting the first end of the body, a second leg substantially parallel to the first end of the body and a third leg intersecting the first end of the body at a location spaced from the first leg the first end fracture guide.

4. The packaging box of claim 3, wherein the first and third legs of the first end fracture guide are substantially parallel to one another.

* * * * *